United States Patent [19]

Clary

[11] 4,072,919

[45] Feb. 7, 1978

[54] SOLENOID CONSTRUCTION

[75] Inventor: John G. Clary, Pasadena, Calif.

[73] Assignee: Addmaster Corporation, San Gabriel, Calif.

[21] Appl. No.: 738,452

[22] Filed: Nov. 3, 1976

[51] Int. Cl.[2] ..... H01F 7/16

[52] U.S. Cl. ..... 335/257; 335/248

[58] Field of Search ..... 335/257, 277, 46, 104, 335/193, 247, 248, 157, 90, 105, 156, 192; 267/140, 141, 153; 310/30

[56] References Cited

U.S. PATENT DOCUMENTS

| | | | |
|---|---|---|---|
| 1,226,748 | 5/1917 | Burnham | 335/257 |
| 3,184,622 | 5/1965 | Levine | 310/30 |
| 4,010,940 | 3/1977 | Freyler | 267/153 |

FOREIGN PATENT DOCUMENTS

| | | | |
|---|---|---|---|
| 2,400,176 | 7/1975 | Germany | 267/141 |

*Primary Examiner*—Harold Broome
*Attorney, Agent, or Firm*—Fred N. Schwend

[57] ABSTRACT

A solenoid having reduced noise and jarring characteristics which includes a small shock absorbing sphere of rubber or other elastomeric material freely mounted between the solenoid armature and a stationary core piece of the solenoid so as to be engaged and compressed by the armature at the end of its travel.

5 Claims, 4 Drawing Figures

SOLENOID CONSTRUCTION

BACKGROUND OF THE INVENTION

1. Field of the Invention

This invention relates to solenoids and has particular reference to solenoids of the general type having an armature of magnetic material which is slideable endwise within an electromagnetic coil and which is drawn within the coil upon energization of the latter.

2. Description of the Prior Art

Solenoids of the above type exert an actuating force along the length of travel of the armature. Generally, in order to provide maximum efficiency, a stationary core or other element of magnetic material is provided at the end of the coil opposite the armature in order to concentrate the magnetic flux in the path of the armature and across the gap between the armature and the core element. This results in the armature exerting a force which increases as it approaches the end of its travel, i.e., as it approaches the core element. Such increase in force generally develops at substantially an exponential rate and, without a shock absorber of some kind, the armature tends to slam into the core or other stop element, creating a loud noise and jarring effect. Such noise etc., is undesirable in certain applications, such as in calculating and business machines intended to be used in offices or other places where noise is highly objectionable.

Heretofore, the above problem has usually been solved by providing an elastomeric bumper which is attached to some stationary element, such as the solenoid frame, and is located in the path of the armature or other element operated thereby. In order to effectively bring the armature and any train of elements connected thereto to a halt without creating the above noted noise or jarring effect, the bumper must normally be made relatively large and the material thereof must be made soft enough to gradually absorb the shock over a relatively long distance. Additionally, adjustment provisions must normally be provided in cases where it is desirable to have the armature come to rest at a precise location.

It is known that if the bumper is made with a blunt or flat engaging surface, the initial impact of the armature may still tend to produce a jarring effect unless the bumper is made of extremely soft material. This effect is decreased by forming the bumper with a semi-spherical or conical engaging end so that the initial impact is less and the resistance to deformation of the bumper gradually increases as the armature approaches the end of its travel. However, since the bumper must be supported at one end, only the opposite end can be so formed to provide such gradually increased resistance to the movement of the armature.

SUMMARY OF THE INVENTION

A principal object of the present invention is to provide an inexpensive and yet reliable arresting device for a solenoid armature which is effective to reduce the noise and jarring normally caused by the armature as it reaches the end of its travel.

Another object is to provide an extremely simple shock absorbing device which is effective to arrest the solenoid armature within a relatively short distance with a minimum amount of noise and jarring effect.

According to the present invention, a solenoid is provided having a coil bobbin or sleeve in which a magnetic core element is secured within the end of the bobbin opposite that which slideably supports the armature. A small sphere of elastomeric material, such as rubber, is freely mounted within the space between the core element and the armature to form a shock absorbing bumper. Due to its spherical shape and free mounting, the bumper will be gradually and concurrently deformed or compressed at diametrically opposite ends at a substantially exponential rate in order to decelerate the armature to a rest position in an extremely short period of time and with a minimum amount of noise and jarring. Since the sphere is concentric about its center it need not be oriented in any manner. Further, since the sphere is relatively small, there will be very little, if any, variation in the stopping position of the armature and any element or train of elements connected thereto. Also, because of the small diameter of the sphere, the armature can be actuated until it is relatively close to the core element to thus develop a maximum amount of force.

Since the cost of elastomeric spheres of the above type is extremely small and the work involved in assembling the same is infinitesimal, the overall cost of such a shock absorbing device is likewise extremely small, while providing superior shock absorbing characteristics.

An additional advantage accruing from applicant's invention is that the elastomerical sphere prevents metal-to-metal contact between the armature and the core element to eliminate sticking of the armature due to residual magnetism remaining in the armature or core element or both after the electromagnetic coil has been deenergized.

BRIEF DESCRIPTION OF THE DRAWING

The manner in which the above and other objects of the invention are accomplished will be readily understood on reference to the following specification when read in conjunction with the accompanying drawing, wherein.

DESCRIPTON OF THE PREFERRED EMBODIMENT

Figure 1:
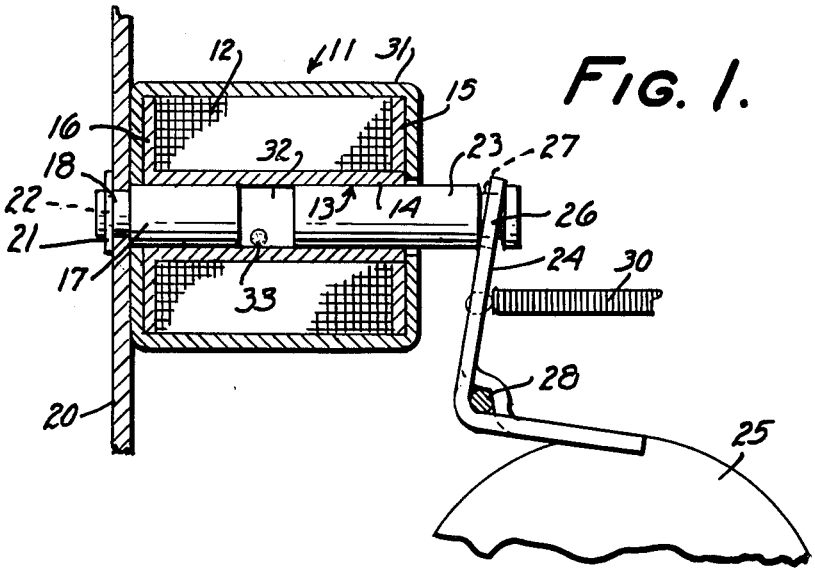
FIG. 1 is a longitudinal sectional view through a solenoid embodying a preferred form of the present invention.

Referring to the drawing, the solenoid is generally indicated at 11 and comprises a solenoid coil 12 wound on a bobbin 13 comprising a cylindrical bearing sleeve 14 of non-magnetic material, such as brass, and two end flanges 15 and 16 integrally secured to the opposite ends of the sleeve. Such flanges 15 and 16 may be either of magnetic material or nonmagnetic material.

A core element of 17 of magnetic material, such as soft iron, is suitably secured within the sleeve 14 and extends about half way there along. The element 17 has a reduced diameter section 18 which is fitted within a hole in a frame plate 20 and is secured thereto by a retainer clip 21 which is seated in a circumferential groove 22 formed in the element 17.

A cylindrical armature 23 of magnetic material, such as soft iron, is slideably mounted in the end of the sleeve 14 opposite that in which the core element is secured. The armature 23 is shown as being operatively connected to a clutch dog 24 for controlling a clutch 25. For this purpose, the armature is provided with a circumferential groove 27 which is loosely engaged by a forked end 26 of a clutch dog 24. The latter is supported for pivotal movement on a support rod 28 and is urged clockwise by a tension spring 30 to normally hold the clutch dog in clutch disengaging engagement with the clutch 25 and to hold the armature 23 in a partially withdrawn position.

A casing 31 of magnetic material, such as soft iron, surrounds the coil 12 and the end flanges 15 and 16 of the bobbin 13 to form a magnetic flux path associated with the coil. The flux path thus extends through the core element 17, armature 25 and the air gap 32 formed therebetween.

Accordingly, when the coil 12 is energized, a magnetic flux will be developed across the air gap 32 to draw the armature 23 inwardly toward the core element 17 to rock the clutch dog 24 counterclockwise so as to release the clutch 25 for engagement.

According to the present invention, a small sphere 33 of rubber or similar elastomeric material is freely mounted in the sleeve 14 intermediate the adjacent ends of the core element 17 and the armature 23. As the armature 23 moves inwardly through its travel it advances the sphere 33 toward the core element 17, and just before reaching the end of its travel, it impacts the sphere 33 against the core element.

As is well known, the force of attraction by the magnetic flux extending across the air gap 32 increases inversely in proportion to the square of the distance across the air gap 32 and such force is likewise applied to the armature 23. Therefore, although such force may attenuated somewhat by the spring 30, it will be seen that the force of attraction increases appreciably as the armature approaches the end of its travel.

Figure 2:
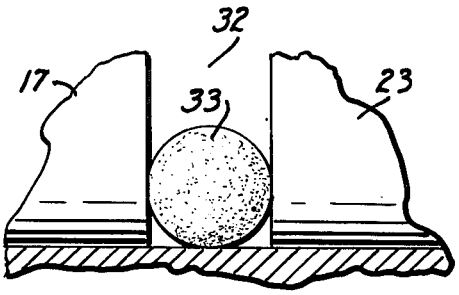
FIG. 2 is an enlarged fragmentary schematic view illustrating the condition of the shock absorbing sphere at the initial moment of impact of the armature there against.
Figure 3:
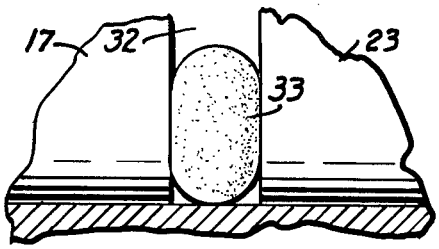
FIG. 3 is a schematic view similar to FIG. 2 but illustrating the deformation of the shock absorbing sphere when the armature is partly arrested thereby.
Figure 4:
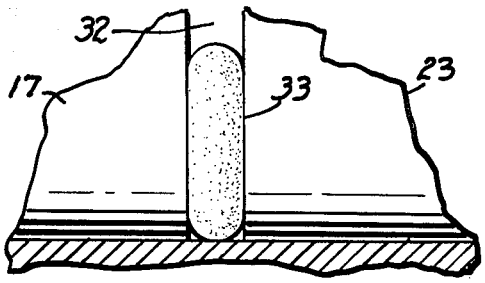
FIG. 4 is a schematic view similar to FIGS. 2 and 3 but illustrating the deformation of the shock absorbing sphere when the armature is fully arrested thereby.

As will be noted on reference to FIG. 2, at the initial point of impact of the armature 23 against the sphere 33 when the latter is in engagement with the core element 17, only a minute area of contact exists. Accordingly, the sphere 33 offers only a minimum amount of resistance to deformation on diametrically opposite sides thereof. This resistance, however, increases at some exponential rate as the area of contact increases during further deformation or compression of the sphere. Thus, at an intermediate point in the arresting process, as seen in FIG. 3, the area of contact between the sphere 33 and both the core 17 and armature 23 is increased considerably thus increasing the resistance accordingly. Finally, a maximum area of contact, and therefore resistance, is reached, as will be noted in FIG. 4, to arrest the armature.

It has been found that because of the above noted superior shock absorbing characteristics of the free elastomeric shpere 33, the diameter thereof can be reduced to a size considerably smaller than the diameter of the armature 23. For example, considering a sphere of rubber having a normal Shore hardness on the order of 50, the diameter may be made one quarter or less than the diameter of the armature and still retain the above noted shock absorbing characteristics. Thus, in a small solenoid having an armature of one-fourth inch diameter, the sphere need be only one-sixteenth inch diameter. Also, because of the above noted shock absorbing characteristic and the possible reduction in diameter of the sphere, the armature can be brought closely adjacent the core element during its operating travel to obtain greater actuating force. Further, because of the resulting small diameter of the shock absorbing sphere, the armature can be more accurately brought to a precise arrested position.

It will be obvious to those skilled in the art that many variations may be made in the exact construction shown without departing from the spirit of this invention.

I claim:

1. A solenoid comprising a bearing sleeve, a stop element of magnetic material in said sleeve adjacent one end of said sleeve, said stop element forming a first flat sphere engaging surface, an armature of magnetic material slidable endwise within said sleeve adjacent the opposite end of said sleeve, said armature forming a second flat sphere engaging surface, means for inducing magnetic flux between said stop element and said armature whereby to attract said armature towards said stop element, and a shock absorbing sphere of elastomeric material within said sleeve intermediate said armature and said stop element, said sphere being freely mounted between said armature and said stop element and being compressible between said first and second sphere engaging surfaces whereby to arrest said armature, said sphere engaging surfaces being parallel to each other and at right angles to the direction of movement of said armature.

2. A solenoid as defined in claim 1 wherein said sphere is free to roll within said sleeve when said armature is in unarrested condition.

3. A solenoid as defined in claim 1 wherein said sleeve is cylindrical and said sphere has a diameter not over one-fourth the diameter of said sleeve.

4. A solenoid comprising a bearing sleeve, a stop element within said sleeve adjacent one end of said sleeve, said element having a first flat sphere engaging surface, an armature of magnetic material slidable lengthwise within said sleeve adjacent the opposite end of said sleeve, said armature having a second flat sphere engaging surface, an electromagnetic coil surrounding said sleeve and effective upon energization thereof to develop a magnetic flux to attract said armature towards such stop element, and a shock absorbing sphere of elastomeric material within said sleeve intermediate said first and second sphere engaging surfaces, said sphere being compressible between said stop element and said armature whereby to arrest said armature, said sphere engaging surfaces being parallel to each other and at right angles to the direction of movement of said armature.

5. An actuator comprising means comprising a cylindrical slide bearing, said bearing being open at one end and closed at the opposite end, said closed end of said bearing having a sphere engaging surface, a plunger slidable in said bearing, means for moving said plunger towards said closed end, said plunger having a second sphere engaging surface, means actuated by said plunger upon movement thereof to a location adjacent said closed end for performing a control function, a shock absorbing sphere of elastomeric material intermediate said sphere engaging surfaces, said sphere being freely mounted within said bearing and compressible between said sphere engaging surfaces whereby to arrest said plunger after said plunger reaches said location, said sphere engaging surfaces being planar, and said sphere engaging surfaces being parallel with each other and extending at right angles to the direction of movement of said plunger.

* * * * *